United States Patent [19]

Agassi et al.

[11] 4,288,950

[45] Sep. 15, 1981

[54] MULTIPLE-BUILDING CONSTRUCTION SYSTEM AND METHOD OF ERECTING SAME

[76] Inventors: Abraham Agassi, 28 King David St., Tel Aviv; Amnon Levy, Kibbutz Givat, Chaim-Ihud, both of Israel

[21] Appl. No.: 63,415

[22] Filed: Aug. 30, 1979

[51] Int. Cl.[3] ..... E04H 1/04

[52] U.S. Cl. ..... 52/79.12; 52/236.1; 52/646; 52/648; 52/741

[58] Field of Search ..... 52/30, 236.1, 79.1, 52/79.7, 79.12, 79.13, 646, 648, 263

[56] References Cited

U.S. PATENT DOCUMENTS

| | | | |
|---|---|---|---|
| 1,849,273 | 3/1932 | Broderick | 52/648 |
| 1,911,018 | 5/1933 | Goeltz | 52/648 |
| 2,168,725 | 8/1939 | Whelan | 52/79.13 |
| 3,721,056 | 3/1973 | Toan | 52/79.12 |
| 3,744,193 | 7/1973 | Lau | 52/30 |
| 3,792,558 | 2/1974 | Berce et al. | 52/79.7 |
| 4,012,871 | 3/1977 | Netto et al. | 52/79.1 |

*Primary Examiner*—James L. Ridgill, Jr.
*Attorney, Agent, or Firm*—Benjamin J. Barish

[57] ABSTRACT

A three-dimensional multiple-building construction system for a plurality of three-dimensional, multiple-room housing units is described characterized in that it comprises a three-order hierarchy of frame members, the first order frame members including a superstructure framework channelling substantially the complete load of the system to the ground, the second order frame members including at least one intermediate box-like framework defining a three-dimensional open grid of beams and columns, and the third order frame members including further beams and columns attached to the beams and columns of the intermediate block-like framework as components of the housing units, such that the load of the housing units attached to the third order frame members are transmitted from the latter members to the second order frame members, from the latter to the first order frame members, and from the latter to the ground.

19 Claims, 16 Drawing Figures

MULTIPLE-BUILDING CONSTRUCTION SYSTEM AND METHOD OF ERECTING SAME

BACKGROUND OF THE INVENTION

The present invention relates to a multiple-building housing construction system, and to a method for erecting such a system.

Where privacy, out-door living conveniences (e.g. backyard, garden, etc.), and flexibility of design are required in a building unit, it is usually necessary to build separate detached or semi-detached units e.g. houses or villas, on individual lots. However, this permits only low density building. Where higher density building is desired in a limited space, this is usually provided by multiple-level building structures, such as multiple-level apartments or office buildings, but such constructions considerably limit the privacy, out-door living conveniences, and flexibility of design.

SUMMARY OF THE INVENTION

The present invention provides a new multiple-building construction system which enables higher density building to be attained in a limited space, and which still provides each building unit with a high degree of privacy, out-door-living conveniences, and flexibility of design heretofore usually obtainable only when building separate detached or semi-detached units on individual lots. The novel multiple-building construction of the present invention also enables the use of spaces which, because of the natural or built-up topography, would not otherwise be suitable for building. In addition, it provides flexibility not only in the original design of each building or housing unit, but also in the changes that can be subsequently made in a convenient manner, e.g., to enlarge the original building unit or to change its layout.

According to a broad aspect of the present invention, there is provided a multiple-building construction system for a plurality of three-dimensional, multiple-room housing units, characterized in that the system comprises a three-order hierarchy of frame members, the first order frame members including a superstructure framework channelling substantially the complete load of the system to the ground, the second order frame members including at least one intermediate box-like framework defining a three-dimensional open grid of beams and columns, the third order frame members including further beams and columns attached to the beams and columns of the intermediate block-like framework and define components of the multiple-room housing units, such that the load of the housing units attached to the third order frame members are transmitted from the latter members to the second order frame members, from the latter to the first order frame members, and from the latter to the ground.

The multiple-building construction system of the present invention, based on a three-order hierarchal structure of frame members, is to be distinguished from conventional constructions based on a single order of frame members, and has a number of important advantages thereover.

Thus, by providing three separate orders of frame members, the present invention enables each order of frame members to be designed according to its particular functional requirements; this is highly advantageous over the conventional single-order construction wherein there is no such separation of orders, and therefore every unit depends upon and is limited by the overall construction system. Further, in the novel construction system of the present invention, the first-order frame members, constituted by the superstructure framework, channels substantially all the load of the system to the ground; this avoids cluttering the ground level with a grid of vertical columns, and also leaves the ground level free to span natural or built-up topography or other superstructure frameworks. Moreover, the separation of each housing unit from the ground, except via the intermediate box-like framework and the superstructure framework, contributes to the openess, flexibility of design, and the other advantages provided by the system of the present invention, while still enabling a high degree of building density to be attained in a limited space.

In the preferred embodiment of the invention described below, the intermediate box-like framework, constituting the second order frame members, comprises a first group of horizontal beams joined to each other to form a lower two-dimensional open rectangular grid, a second group of horizontal beams joined to each other to form an upper two-dimensional open rectangular grid, and a group of vertical columns joined to the beams of the two rectangular grids at their intersection points to form therewith the three-dimensional open grid of beams and columns to which the third order frame members are attached.

Further, in the described preferred embodiment, the superstructure framework (constituting the first order frame members) include end trusses to which are attached the opposite end of the intermediate box-like framework (constituting the second order frame members).

In most applications of the three-dimensional multiple-building construction system of the present invention, the superstructure end trusses would support two (or more) of the intermediate box-like frameworks each adapted to have the components of a cluster of building of housing units attached thereto in vertically and horizontally spaced relationship to each other, said two intermediate box-like frameworks being attached to the superstructure end trusses at vertically and horizontally staggered positions, thereby maximizing the light and air available to each cluster of building or housing units and to each of the individual units within a cluster.

This novel construction also permits at least some of the building or housing units to include components attached to lower horizontal beams of the respective box-like framework, other components attached to upper horizontal beams of the respective box-like framework, and still other components attached to vertical columns of the respective intermediate box-like frame.

According to a further aspect of the invention, there is provided a method of constructing the above-described three-dimensional multiple-building system, characterized in first erecting the superstructure framework including said first order frame members channelling substantially all the load of the system to the ground; then attaching to said superstructure framework at least one of said intermediate box-like frameworks constituted said second order frame members and defining the three-dimensional open grid of beams and columns; then attaching said further beams and columns, constituting said third order frame members, to the beams and columns of the intermediate box-like framework; and then attaching to said further beams and columns the components of the multiple-room housing units.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

Figure 1:
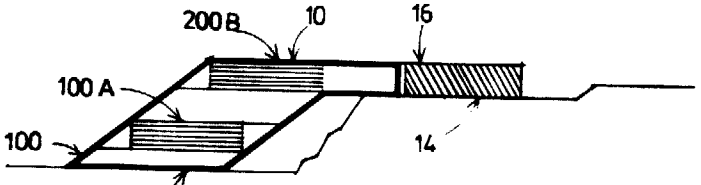
FIG. 1 schematically illustrates one application of the multiple-building construction system of the present invention.

With reference to FIG. 1, there is shown one typical application of the three-dimensional multiple-building construction system of the present invention, namely for spanning a rise in the land, which rise might otherwise make the land unsuitable for building. Thus, the system shown in FIG. 1 includes a framework, generally designated 10, spanning the rise in the land between areas 12 and 14. Another framework 16 is illustrated at the top of the rise in alignment with the upper end of framework 10.

With respect to framework 10, this framework includes a three-order hierarchy of frame members as discussed above, but only two orders of which are shown in FIG. 1. The first order frame members are generally designated 100, and the second order frame members are generally designated 200. The structure illustrated in FIG. 1 includes two of the second order frame members, these being designated 200A and 200B respectively. Preferably, the frame members of both orders are steel bars. The construction and arrangement of the two orders of frame members 100 and 200 (i.e. 200A, 200B) of FIG. 1 are more particularly illustrated in the enlarged fragmentary view of FIG. 2.

Figure 2:
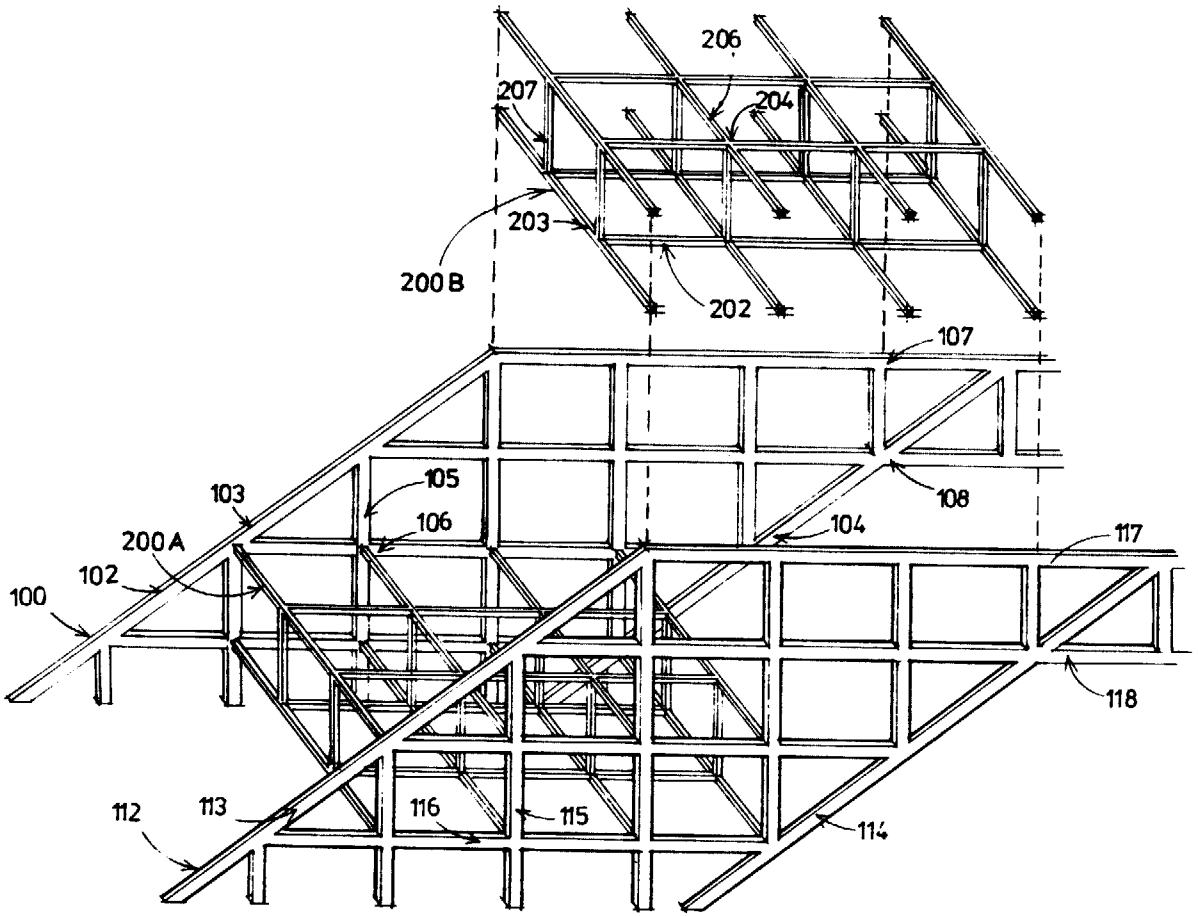
FIG. 2 illustrates a portion of the superstructure framework constituting the above-mentioned first order frame members, this figure particularly illustrating the construction of two intermediate box-like frameworks attached to the superstructure and constituting the above-mentioned second order frame members.

Thus, as shown in FIG. 2, the first order frame members, generally designated 100, include two end trusses 102, 112, each truss in turn including a pair of parallel, inclined, vertically-spaced truss beams interconnected by a plurality of vertical columns and horizontal beams. Thus in truss 102, the inclined truss beams are designated 103,104, the vertical columns are designated 105, and the horizontal beams are designated 106; and in truss 112, the inclined beams are designated 113, 114, the vertical columns are designated 115, and the horizontal beams are designated 116. Each truss includes a horizontal extension at its upper end, the horizontal extensions of the two truss beams in truss 102 being designated 107 and 108, and the horizontal extensions of the two truss beams in truss 112 being designated 117 and 118.

Each of the intermediate box-like frameworks 200A, 200B, constituting the second order frame members, is attached between the two end trusses 102, 112 of the superstructure framework 100 constituting the first order frame members. Both of the intermediate box-like frameworks 200A, 200B are of the same construction but are attached to the end trusses in vertically and horizontally staggered relationship, as shown in FIG. 1 and also in FIG. 2, the attachment points of the higher framework 200B being schematically shown by the broken lines in FIG. 2.

With reference to the upper box-like framework 200B (the lower box-like framework 200A being of like construction), it will be seen that it includes: a first group of horizontal beams, namely longitudinally-extending beams 202 and transversely-extending beams 203 joined to each other to form a lower two-dimensional open rectangular grid; a second group of horizontal beams, namely longitudinally-extending beams 204 and transversely-extending beams 206 joined to each other to form an upper two-dimensional open rectangular grid; and a group of vertical columns 207 joining the beams of the two rectangular grids at intersection points to form therewith a three-dimensional open grid of beams and columns. The ends of the box-like framework are not provided with the vertical columns 207 since these ends are attached to the end trusses 103 and 113. The three-dimensional open grid of beams and columns of the intermediate box-like framework 200B (and also 200A), which beams and columns constitute the second order frame members as mentioned above, are adapted to have secured thereto the components of a plurality of building units, which latter components include further beams and columns constituting the third order frame members, as will be described more particularly below.

Figure 3A:
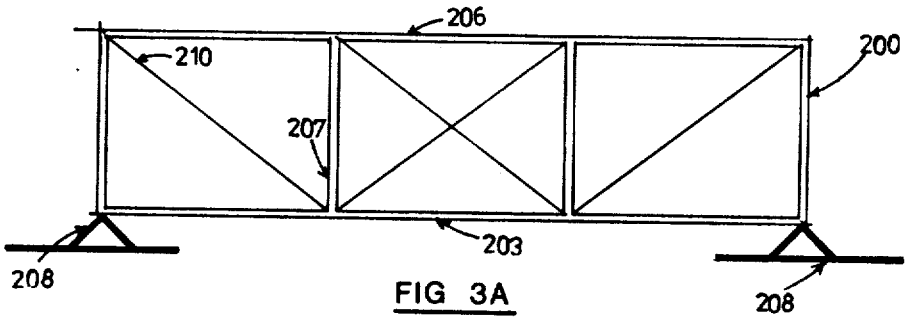
FIGS. 3*a*–3*d* illustrate two arrangements for strengthening the intermediate box-like frameworks against longitudinal thrusts.
Figure 3B:
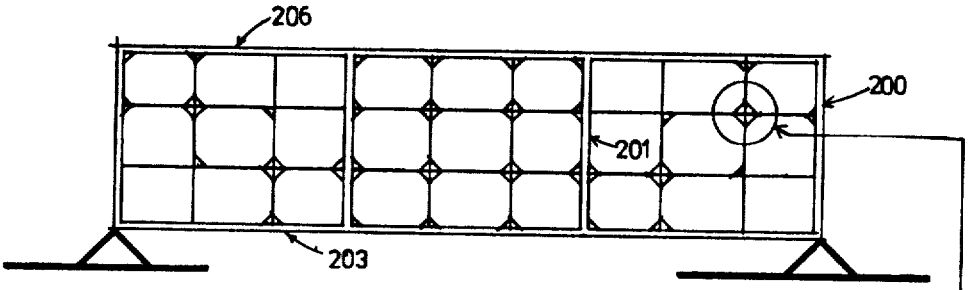

Turning now to FIGS. 3*a*–3*b*, these figures illustrate two manners of strengthening the intermediate box-like framework, therein designated 200, against longitudinal thrusts. Thus, one manner of so strengthening the box-like framework is by the use of diagonal bars, designated 210 in FIG. 3*a*, connected between the transversely-extending horizontal beams 203, 206 and the vertically-extending columns 207.

However, another manner, particularly adaptable by the system of the present invention, for strengthening the box-like frameworks 200 against longitudinal thrusts is by the use of the further beams and columns constituting components of the building units to be attached to the framework, and serving as the third order frame members thereof. These further beams and columns are illustrated in FIG. 3*b*, wherein they are designated 302 and 303, respectively. As shown in FIG. 3*b*, and also in the enlarged fragmentary view of FIG. 3*c*, these further beams and columns 302 and 303, respectively, are joined to gusset plates 304 at their intersections.

It will of course be appreciated that both techniques illustrated in FIGS. 3*a* and 3*b*, respectively, could be used for reinforcing the various transversely-extending vertical sections, or portions thereof, of the intermediate box-like frameworks. Thus, some of the transversely-extending sections, or portions thereof, could include the diagonals 210, and others could include the further beams and columns 302, 303, constituting parts of the building or housing units attached to the overall framework and serving as the third order frame members. One of the advantages of the system of the present invention is that it permits this flexibility in design, according to the desired application.

Figure 3D:
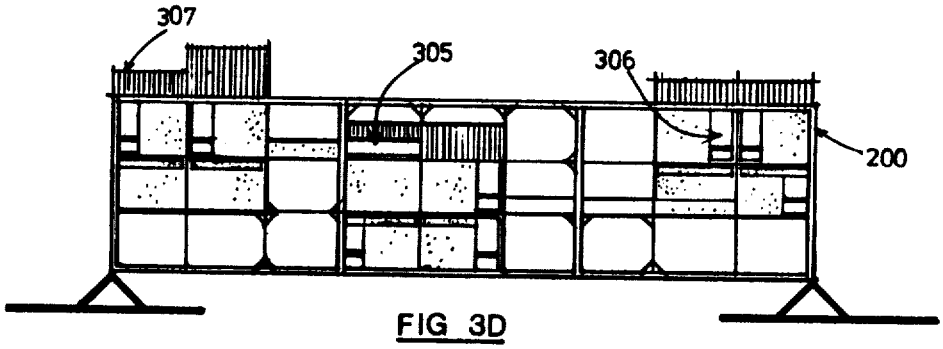
Figure 3C:
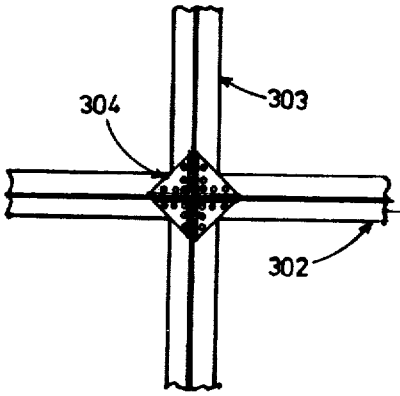
Figure 7:
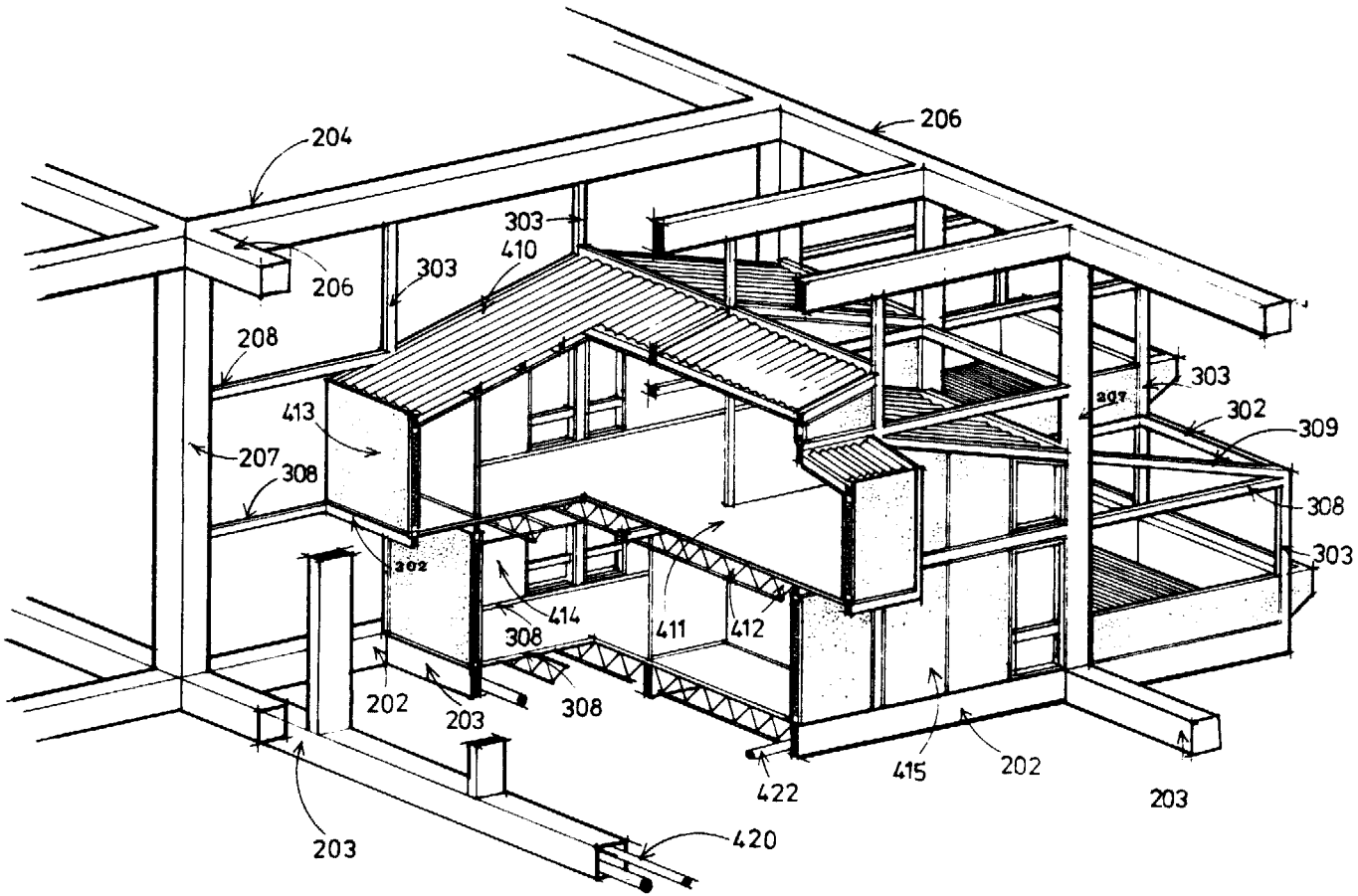
FIG. 7 is an enlarged fragmentary view illustrating one building unit and also the relationship between the second and third order frame members.

As noted above, the beams and columns 302, 303, serving as the third order frame members of the overall framework, are actually components of the building or housing units applied to the framework. FIG. 3*d* illustrates how these beams and columns may be used for attaching other components of the building units to the framework. Thus, as shown in FIG. 3*d*, windows 304 and 306 may be attached to some of the beams and columns 302, 303, a roof 307 may be attached to others, and so on. This will be more particularly described below with respect to FIG. 7 illustrating the construction of one such building unit and the manner of attaching its components to the beams and columns 302, 303 constituting the third order frame members, as well as, in some instances, to beams and columns of the intermediate box-like framework 200 constituting the second order frame members.

Figure 4:
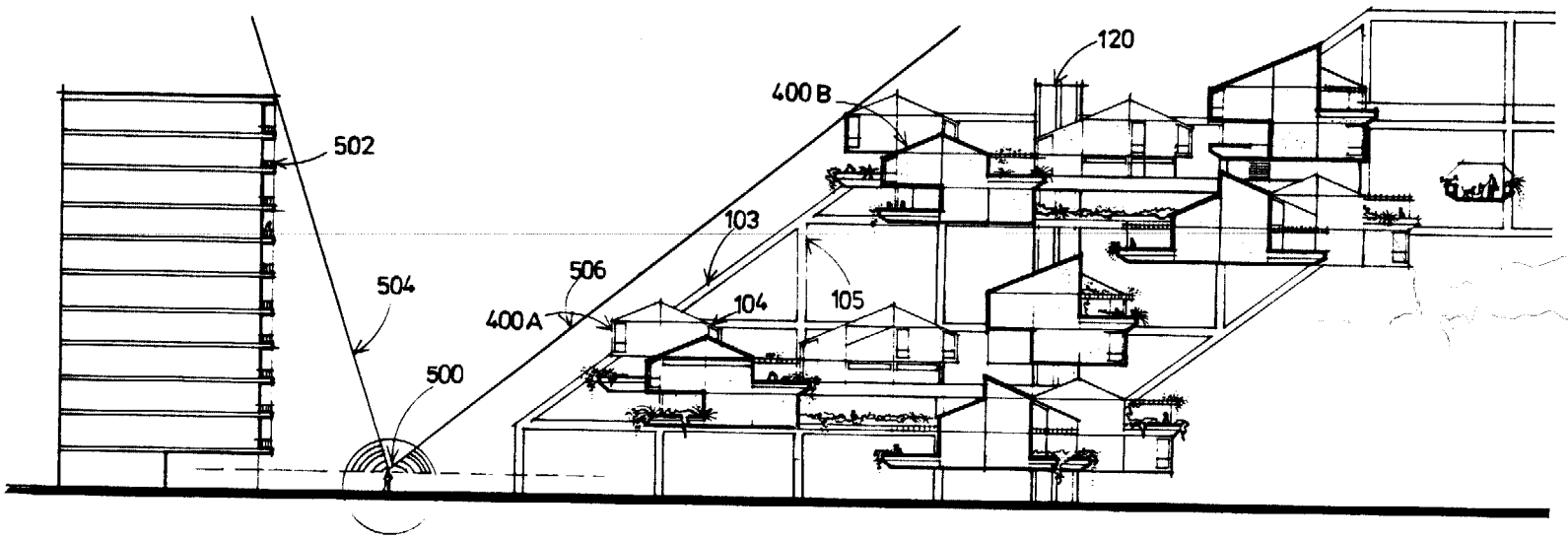
FIG. 4 is a side elevational view illustrating two clusters of building or housing units each attached to one of the intermediate box-like frameworks shown in FIG. 2.

As noted earlier, each of the intermediate box-like frameworks 200A, 200B, constituting the second order frame members of the system, is used for supporting a cluster of building units. This is more particularly illustrated in FIG. 4, wherein one cluster of building units supported by the lower framework 200A is generally designated 400B, and another cluster of building units supported by the upper framework is generally designated 400B. FIG. 4 also illustrates some of the first order frame members, namely the inclined truss beam 103, a horizontal beam 104, and a vertical column 105 included in the end trusses supporting the box-like frameworks 200A, 200B.

FIG. 4 also illustrates another advantage of the novel construction system illustrated herein, namely the more pleasing appearance that the overall system presents to a viewer, as compared to the appearance presented to the viewer by a conventional multiple-unit building construction. Thus, the viewer, designated 500 in FIG. 4, when viewing a conventionally-constructed building, generally designated 502, sees a solid, prominent, high-rise obstructing wall which blocks his view along a large angle, indicated by line 504. In contrast, when the observer 500 views the novel system illustrated in FIG. 4, he sees more-subdued broken lines better merging with each other and with the natural topography, and along a smaller angle of view as indicated by line 506.

FIG. 4 further ilustrates the provision of access means providing access between the various levels of the clusters of building units 400A, 400B, attached to the intermediate box-like framework 200A, 200B. Such access means may be in the form of vertical elevator tunnels at the corners or outer extremities of the superstructure framework 100, so as to minimize the obstruction to horizontal traffic, and may extend to the ground thereby strengthening the superstructure framework. FIG. 4 illustrates only one such vertically-extending elevator tunnel, this being designated 120 since it can be considered as a first order member in the channelling of the overall load directly to the ground.

Figure 5:
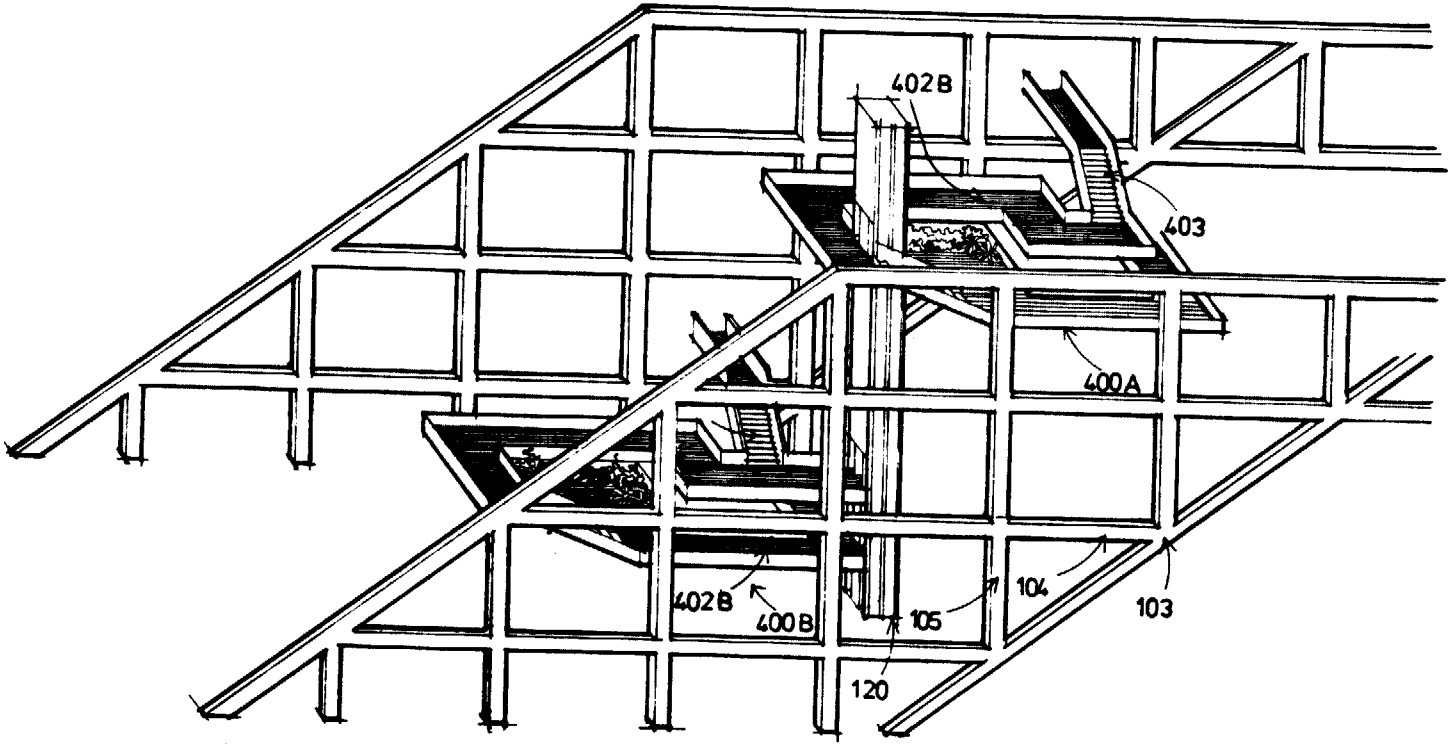
FIG. 5 is an enlarged fragmentary view particularly illustrating the means for providing access between two clusters of building units such as illustrated in FIG. 4.
Figure 6:
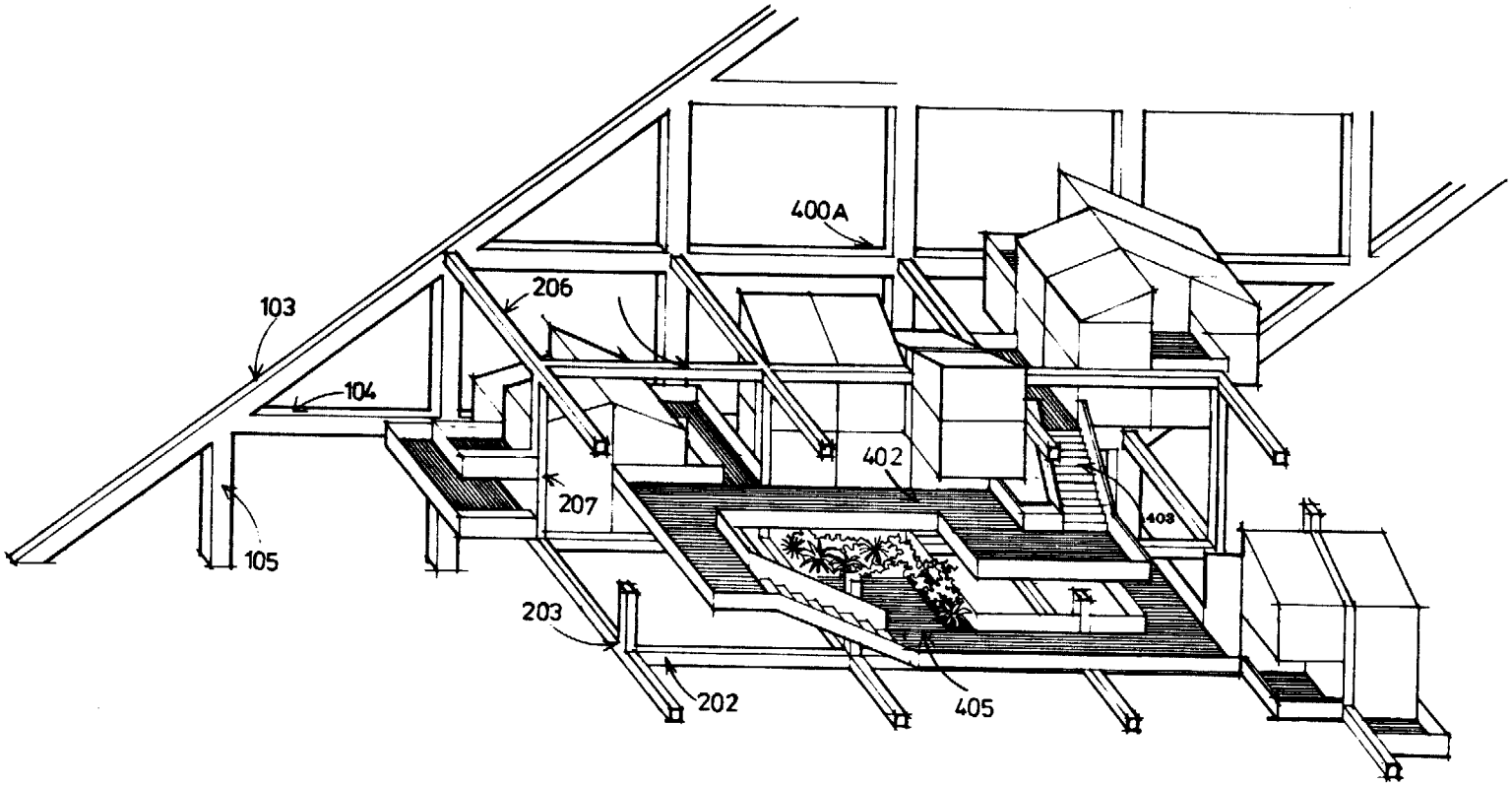
FIG. 6 is a fragmentary view schematically illustrating the location of the building units in a single cluster, and also the relationship betwen the first and second order frame members.

FIG. 5 illustrates the provision of access means between the two clusters of building units 400A, 400B; and FIG. 6 illustrates the provision of access means to the various building units within a single cluster, e.g. cluster 400A.

Thus, as shown in FIG. 5 the vertically-extending elevator tunnel 120, which as mentioned above extends for the complete vertical height of the system to the ground and is located preferably at the corners of the superstructure, is connected to a pedestrian walk 402A within the upper cluster 400A of building units, this being the cluster supported by the upper box-like framework 200A of FIGS. 1 and 2. Similarly, elevator tunnel 120 is also connected to a pedestrian walk **402*b* in the lower cluster 400B of building units supported by the lower intermediate box-like framework 200B in FIGS. 1 and 2. The various levels between the clusters, and also between the building units within a single cluster, are connected together by stairs such as shown at 403 in FIG. 5**.

FIG. 6 more clearly illustrate the pedestrian walk 402 and stairs 403 providing access between the building units of a single cluster, such as cluster 400A. FIG. 6 also more clearly illustrates the flexibility of this system to accommodate different sizes, configurations, and spacings of building units within a single cluster. Thus, as shown in FIG. 6, each building unit may have a plurality of levels attached, via the further beams 302, 303 etc. and according to various configurations, to the lower horizontal beams 202, 203 of the box-like framework 200, to the upper horizontal beams 204, 206, or to the vertical column 207 of the framework. The open three-dimensional grid of beams and columns defined by each of the intermediate box-like frameworks 200 permits this wide degree of flexibility in the different sizes, configurations and spacing of the building units supported by it.

FIG. 6 also illustrates another important advantage in the novel construction system, in that it permits each building unit to have many of the outdoor living conveniences, such as a backyard 405, heretofore normally available only in separate detached or semi-detached buildings constructed on individual lots.

FIG. 7 illustrates the construction of one such building unit, and particulaly the relationship of the second order frame members (i.e., the beams and columns 203–207 of the intermediate box-like framework 200) with respect to the third order frame members (i.e., the further beams 302 and columns 303 attached to the second order frame members and serving as components of the building unit itself) to which other building unit components are to be secured. As indicated earlier, one of the important advantages of the novel construction system is the high degree of flexibility permitted, not only in the original design of each building unit, but also in the changes that subsequently can be made, e.g. to enlarge the building unit or to change its original layout. One of the reasons permitting this design flexibility is that the beams and columns 302, 303 serving as the third order frame member, as well as the second order frame members 202–207, may be used for attaching thereto the various sections of the building units, such as walls, windows, roof, floor, and other sections.

Thus, as shown FIG. 7, the third order frame members include not only the previously-mentioned transversely-extending beams 302 and vertical columns 303, but also longitudinally-extending beams 308, and if desired, diagonal beams 309. These latter beams and columns are in turn attached, according to the desired configuration of the respective building unit, to the respective beams and columns 202–207 of the intermediate box-like framework 200 serving as the second order frame members of the overall system. For purposes of example, FIG. 7 illustrates a roof section 410 attached to one or more third-order horizontal beams 308 and vertical columns 303; a floor section 411 attached to transversely-extending joists 412 serving as third-order frame members corresponding to members 302; a wall section 413 attached to third-order beams 302 and and 308; and a window section 414 attached to third-order beams 308. It will be appreciated that many of the building unit sections can also be attached directly to the second-order frame members, such as shown by wall section 415 attached to a second-order beam 202.

FIG. 7 further illustrates additional advantages of the novel construction system, in that some of the beams and columns, particularly those constituting the second order members, may also be used for accommodating electrical, heating, or air conditioning ducting to the various units within the cluster. This is shown for purposes of example by ducting 420 in the second-order beams 203, and by ducting 422 in the second-order beam 202.

Turning back to FIG. 1, it will be seen that the superstructure framework, generally designated 10, may be used for supporting a plurality of building clusters, each attached to one of the intermediate box-like frameworks 200A, 200B, to provide various three-dimensional arrangements of the building units supported by the superstructure. In FIG. 1, the superstructure supports the plurality of building units over a rise in the land. Framework 16, which is supported at the top of the rise in horizontal alignment with the upper cluster of framework 200A, may be constructed of a single box-like framework to include a single cluster of building units, and may be supported on a simple superstructure, such as shown at 208 in FIG. 3*a* for example, rather than on a pair of end trusses as in superstructure 100 of FIGS. 1 and 2.

FIGS. 8*a*–8*f* schematically illustrate various other arrangements that may be used to span a large rise in the land, or to form an arch spanning natural or built-up topography or other superstructure frameworks.

Figure 8A:
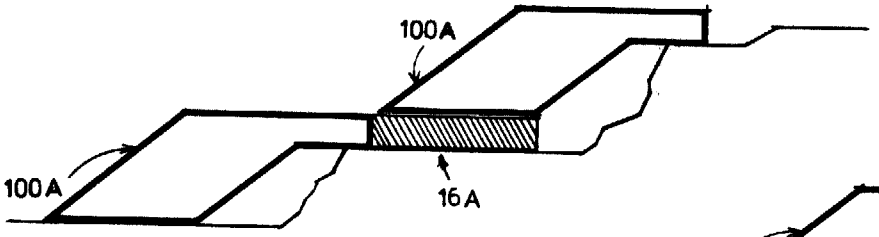
FIGS. 8*a*–8*f* schematically illustrate various applications and arrangements in which the three-dimensional multiple-building construction system of the present invention may be implimented in order to accommodate natural or built-up topography or other superstructure frameworks.

Thus, as shown in FIG. 8*a*, two superstructure frameworks 100A are provided to span a large rise in the land, each of the framework 100A being the same as described above with respect to framework 100. The two frameworks 100*a* are joined in a series, the upper framework 100A being supported on a single-cluster framework 16A, corresponding to framework 16 in FIG. 1.

Figure 8B:
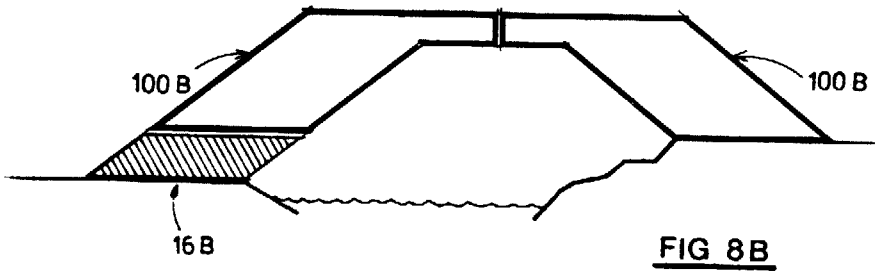

FIG. 8*b* illustrates an arrangement including two superstructure frameworks 100B, each as described above with respect to framework 100 in FIG. 1, spanning a body of water, for example, one of the frameworks (the right one) being supported directly by the land, and the other framework being supported on a single-cluster framework 16B, but one having two end trusses including inclined truss beams, as described above with respect to framework 190 in FIGS. 1 and 2.

Figure 8C:
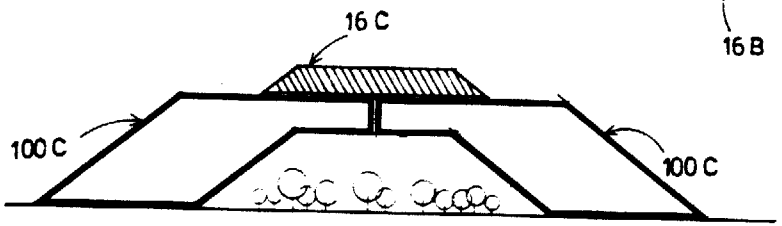

FIG. 8*c* illustrates an arrangement similar to that of FIG. 8*b*, including two separate superstructure frameworks 100C, each as described above with respect to framework 100, the two frameworks in turn supporting at their mid-portions a single-cluster framework 16C having inclined truss beams at its opposite ends.

Figure 8E:
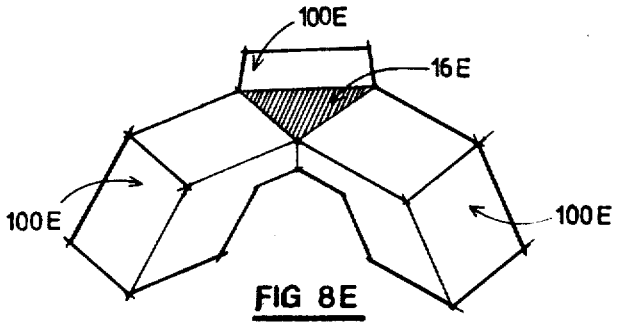
Figure 8D:
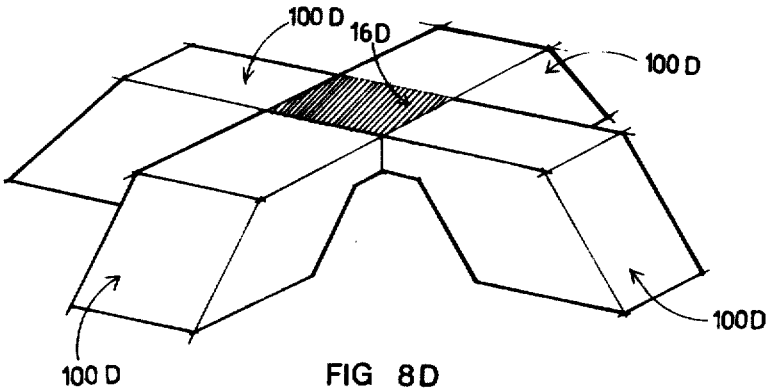

FIG. 8*d* illustrates a further arrangement wherein four of the superstructure frameworks 100D are erected at right angle to each other to span an overlying natural or built-up area, the frameworks in turn supporting at their confronting ends a single-cluster superstructure framework 16D. FIG. 8*e* illustrates a similar arrangement, except including three superstructure frameworks 100E supporting a triangularly-shaped single-cluster framework 16E at their confronting ends.

Figure 8F:
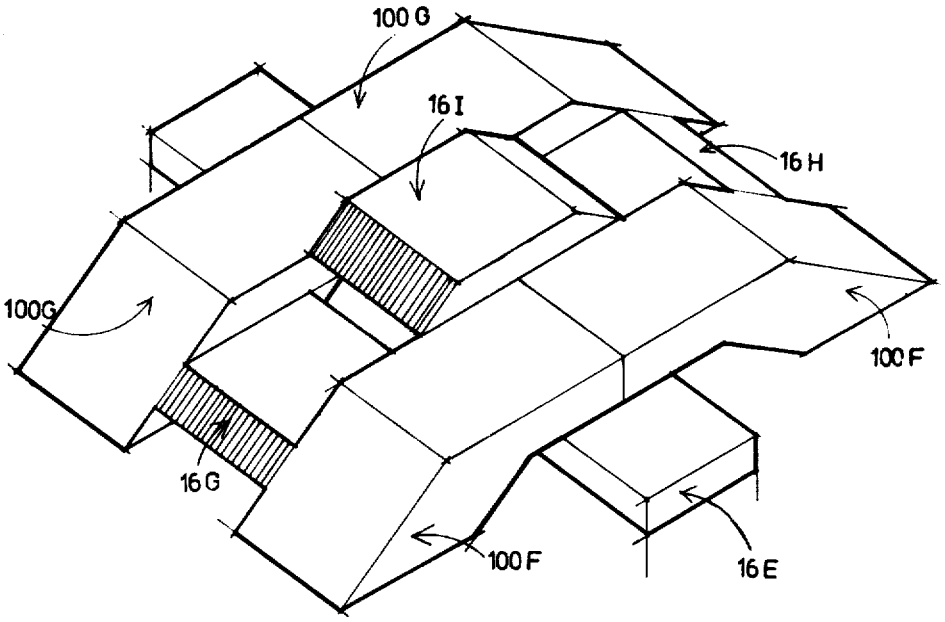

FIG. 8*f* illustrates a still further arrangement, including a first pair of superstructure frameworks 100F arranged to form an arche as in FIG. 8*c*, a second pair superstructure frameworks 100G arranged to form a similar arche but laterally spaced from the first arche, the two pairs of frameworks overlying a long framework 16F, which latter framework includes additional framework sections 16G, 16H and 16I.

It will be appreciated that, whereas the superstructure framework, constituting the first order frame members channelling the load to the ground, are preferably in the form of end trusses, such as end trusses 102 and 112 in FIG. 2, they could be in other forms, for example simple supporting pillars such as schematically illustrated at 208 in FIG. 3*a* for supporting the single-cluster box-like framework 200. In addition, whereas the second order frame members, constituted by the intermediate box-like frameworks, are preferably also isolated from the ground, in some cases it may be desirable to extend them to the ground. Further, when using trusses such as illustrated in FIG. 2 for the superstructure framework channelling the load to the ground, it may be desirable to include one or more intermediate trusses.

Many other variations, modifications and applications of the invention will be apparent.

What is claimed is:

1. A three-dimensional multiple-building construction system for a plurality of three-dimensional, multiple-room housing units, characterized in that said system comprises a three-order hierarchy of frame members, the first order frame members including a superstructure framework channelling substantially the complete load of the system to the ground, the second order frame members including at least one intermediate box-like framework defining a three-dimensional open grid of beams and columns, the third order frame members including further beams and columns attached to the beams and columns of the intermediate block-like framework and define components of the plurality of three-dimensional multiple-room housing units, such that the load of the housing units attached to the third order frame members are transmitted from the latter members to the second order frame members, from the latter to the first order frame members, and from the latter to the ground.

2. A system according to claim 1, wherein said intermediate box-like frame structure included in the second order frame members comprises a first group of horizontal beams joined to each other to form a lower two-dimensional open rectangular grid, a second group of horizontal beams joined to each other to form an upper two-dimensional open rectangular grid, and a group of vertical columns joined to the beams of the two rectangular grids at their intersection points to form therewith the three-dimensional open grid of beams and columns to which said components of the plurality of three-dimensional multiple-room housing units of the third order frame members are attached.

3. A system according to claim 1, wherein there are at least two of said superstructure frameworks erected end-to-end to form an arche spanning natural or built-up topography or other superstructure frameworks.

4. A system according to claim 1, wherein at least some of the beams or columns of the intermediate box-like superstructure framework are used for heating, air conditioning or electrical ducting.

5. A system according to claim 1, wherein said superstructure framework spans a rise in the land, its opposite longitudinal ends being supported at different elevations.

6. A system according to claim 5, wherein there are at least two of said superstructure frameworks erected in series to span a large rise in the land.

7. A system according to claim 1, further including a cluster of individual housing units attached in spaced relationship to the beams and columns of each of the intermediate box-like frameworks.

8. A system according to claim 7, wherein at least some of the housing units include components attached to lower horizontal beams of the respective box-like framework, other components attached to upper horizontal beams of the respective box-like framework, and still other components attached to vertical columns of the respective intermediate box-like frame.

9. A method of constructing a three-dimensional multiple-building system according to claim 1, characterized in first erecting the superstructure framework including said first order frame members channelling substantially all the load of the system to the ground; then attaching to said superstructure framework at least one of said intermediate box-like frameworks constituted said second order frame members and defining the three-dimensional open grid of beams and columns; then attaching said further beams and columns, constituting said third order frame members, to the beams and columns of the intermediate box-like framework; and then attaching to said further beams and columns the components of the multiple-room housing units.

10. A method according to claim 9, wherein said superstructure framework includes end trusses to which the opposite end of the intermediate box-like framework are attached.

11. A method according to claim 10, wherein there are attached to said end trusses at least two of said intermediate box-like frameworks each adapted to have the components of a cluster of housing units attached thereto in vertically and horizontally spaced relationship to each other, said two intermediate box-like frameworks being attached to the superstructure end trusses at vertically and horizontally staggered positions, thereby maximizing the light and air available to each cluster of housing units and to each of the individual units within a cluster.

12. A system according to claim 1, wherein said superstructure framework includes end trusses to which the opposite ends of the intermediate box-like framework are attached.

13. A system according to claim 12, wherein said superstructure end trusses support at least two of said intermediate box-like frameworks each adapted to have the components of a cluster of building multiple-room housing units attached thereto in vertically and horizontally spaced relationship to each other, said two intermediate box-like frameworks being attached to the superstructure end trusses at vertically and horizontally staggered positions, thereby maximizing the light and air available to each cluster of building units and to each of the individual units within a cluster.

14. A system according to claim 13, wherein each of said intermediate box-like frameworks further includes access means for connecting together the plurality of housing units within a cluster.

15. A system according to claim 13, wherein said superstructure framework includes vertically-extending access means at its outer extremities providing access between the various levels of the clusters of housing units attached to the intermediate box-like frameworks.

16. A system according to claim 15, wherein said vertically-extending axis means includes vertical elevator tunnels extending to the ground and strengthening the first degree frame members of the superstructure framework.

17. A system according to claim 13 wherein the beams and columns of said superstructure framework and each of said intermediate box-like frameworks are made of steel bars.

18. A system according to claim 17, wherein each of said intermediate box-like frameworks is strengthened against longitudinal thrusts by diagonal bars.

19. A system according to claim 17, wherein each of said intermediate box-like frameworks is strengthened against longitudinal thrusts by said further beams and columns joined to gusset plates at their intersections.

* * * * *